United States Patent [19]

Miramanda

[11] Patent Number: 4,515,752

[45] Date of Patent: May 7, 1985

[54] STOPPER FOR CONTAINERS FOR USE IN ANALYSES

[76] Inventor: Fernando X. Miramanda, Pau Casals 8-10, Caldes de Montbui (Barcelona), Spain

[21] Appl. No.: 504,432

[22] Filed: Jun. 15, 1983

[30] Foreign Application Priority Data

Jun. 18, 1982 [ES] Spain ..... 266.599[U]

[51] Int. Cl.[3] ..... B65D 51/16; B65D 39/00

[52] U.S. Cl. ..... 422/99; 215/307; 215/355; 220/367; 422/102

[58] Field of Search ..... 141/358, 285, 292, 301, 141/310, 311; 215/307, 355; 220/367; 422/99, 102; 604/167, 169, 237, 256, 905

[56] References Cited

U.S. PATENT DOCUMENTS

| | | | |
|---|---|---|---|
| 91,899 | 6/1869 | Beaumont | 141/310 X |
| 2,436,291 | 2/1948 | Daniel | 215/307 X |
| 3,288,318 | 11/1966 | Corbin et al. | 422/102 X |
| 3,850,174 | 11/1974 | Ayres | 422/102 X |
| 3,948,261 | 4/1976 | Steiner | 215/307 X |
| 4,000,739 | 1/1977 | Stevens | 604/167 X |
| 4,134,512 | 1/1979 | Nugent | 215/247 |

FOREIGN PATENT DOCUMENTS

| | | | |
|---|---|---|---|
| 245246 | 9/1962 | Australia | 215/307 |
| 650443 | 12/1962 | Italy | 215/307 |
| 177245 | 3/1922 | United Kingdom | 141/285 |

*Primary Examiner*—Michael S. Marcus
*Assistant Examiner*—Michael S. Gzybowski
*Attorney, Agent, or Firm*—Staas & Halsey

[57] ABSTRACT

A stopper for containers for use in analyses including a resilient body having a cavity closed by a perforatable transverse wall provided with slits defining segments. The slits allow for the opening of the stopper when a tubular member is inserted in the cavity and closing the stopper when the segments return to the initial position thereof. The cavity is provided with a plurality of longitudinal ribs adapted for defining passages for air between the body and the tubular member. The stopper may slide within the container.

2 Claims, 3 Drawing Figures

STOPPER FOR CONTAINERS FOR USE IN ANALYSES

BACKGROUND OF THE INVENTION

1. Field of the Invention

This invention relates to a stopper for containers for use in analyses, being particularly useful as a closing and opening member for fluid containing vessels.

The stopper is of the type comprising a resilient body, provided with an internal cavity closed by a transverse wall perforatable by a tubular member adapted for transferring the fluid from the container to the tubular member.

2. Description of the Prior Art

Several devices have been hitherto known comprising a test-tube type container containing 9 fluid or specimen to be analysed or for use in analysis, which comprises a sealing stopper for inserting the fluid in the container or withdrawing it therefrom. The known devices and techniques, while having overcome certain drawbacks, maintain a high contact time of the contained fluid with the ambient air due to the fact that the container has to be opened and closed each time a specimen has to be taken or inserted.

Embodiments are also known comprising essentially a hollow resilient stopper having a perforatable wall, disposed in the container and allowing for the insertion or removal of specimens by a conventional tubular member which tapers slightly at the front end thereof such as a pipette; nevertheless, once the wall has been perforated, it also allows extended contact with the ambient surroundings.

SUMMARY OF THE INVENTION

The inventive stopper is particularly useful for the insertion and removal of samples without having to perforate the wall previously and being of the type described above, it is characterised in that the transverse wall is provided with at least one slit defining segments whose edges tend to remain abutting one another and which move apart and allow the stopper to be opened when the tubular member is inserted in the internal cavity through the wall and to be closed when the segments return to the initial position thereof on removal of the tubular member.

According to a further feature of the inventive stopper, the internal cavity is provided with a plurality of longitudinal ribs which, when the tubular member is inserted in the stopper, define longitudinal passages between the tubular member and the stopper to allow for communication between the inside of the container and the outside environment so that any change in the pressure inside of the container can be compensated for with minimum contact with the outside environment.

BRIEF DESCRIPTION OF THE DRAWINGS

To facilitate the description and an understanding of the inventive stopper, reference is made to the attached drawing in which there is provided an example of the inventive stopper intended only as an illustration but not as a limitation thereof. In the drawing.

DESCRIPTION OF THE PREFERRED EMBODIMENT

With reference to the figures, the stopper for containers is for use in clinical analysis and is specially useful for sampling purposes. The stopper allows fluids to be inserted in or removed from the interior of containers such as test-tubes, without having to remove the stopper; the fluids may comprise analytical specimens (blood, serum, urine, foodstuffs, etc.), reagents, standards, controls, etc. The inventive stopper comprises a body 1 formed of resilient material and shaped like a sleeve closed at one end by a transverse wall 2 having one or more radial slits 3 dividing the transverse wall into a plurality of segments 4, the transverse wall 2 being provided in the illustrated embodiment with six slits and six segments, such that under its own resilience the transverse wall closes hermetically in the normal position, since the edge of the segments 4 stay in mutual abutting contact.

Figure 1:
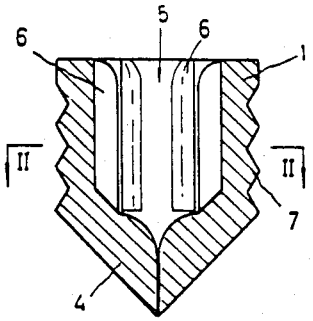
FIG. 1 is an axial cross sectional view of the inventive stopper.
Figure 2:
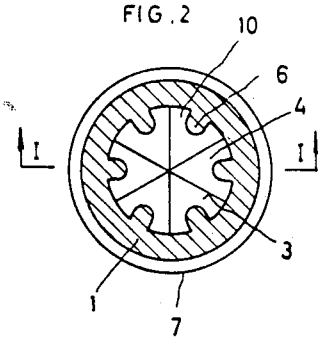
FIG. 2 is a sectional view along the line II—II of FIG. 1.

The body 1 is provided with an internal cavity 5 having plurality of longitudinal ribs 6 as illustrated in FIG. 2, the purpose of the rib 6 is described hereinafter. The outer surface of the body 1 is further provided with a number of annular protuberances or rings 7 improving the adaptation of the body 1 to the inside surface of a test-tube like container 8 which contains the fluid S in question, such as blood, reagents, etc. The resilience of the constituent material of the stopper hermetically closes the container by the action of the transverse wall 2 because the segments 4 of the transverse wall 2 are compressed and retain a perfect hermetic seal, thereby allowing the fluid S contained in the container 8 to be kept in perfect condition without any possibility of contamination.

Figure 3:
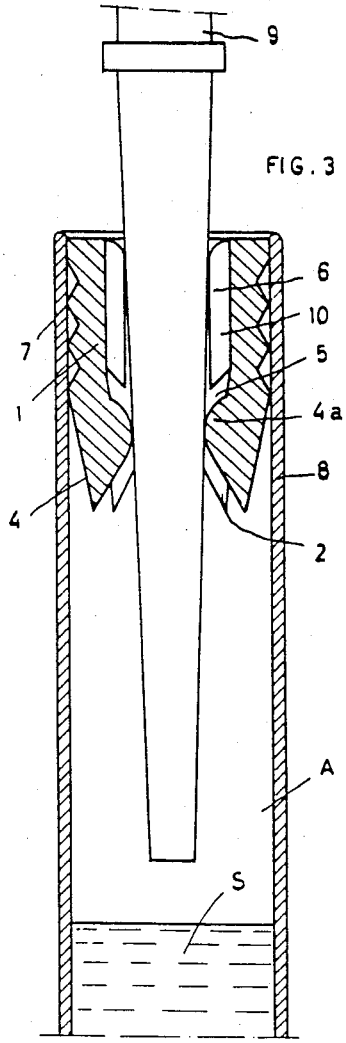
FIG. 3 is an axial sectional view of the stopper adapted to a container, the stopper being held open by penetration of the tubular member.

When it is desired to take a specimen of the fluid S for carrying out the corresponding clinical analysis, a tubular member 9 having any desirable conventional shape such as a pipette having a slightly tapered shape at the front end thereof is inserted in the cavity 5 of the body 1. The tubular member 9 opens the transverse wall 2 in order to pass through it by separating the segments 4 (as shown in FIG. 3). The curved portions 4*a* of the segments 4 allow the tubular member 9 to contact the segments 4 essentially in a single tangential point. The arrangement of the longitudinal ribs 6 in the cavity 5 defines longitudinal passages 10 between the cavity and the tubular member allowing for the passage of the air A contained in the space defined between the stopper and the fluid S. This passage of air is necessary both when the stopper is moveable within the container and to compensate for any variation in the fluid volume. When the pipette 9 is inserted in the fluid, the fluid S is allowed to rise up the pipette 9 by suction of any known type and when the desired amount of fluid S has been passed to the pipette 9, the pipette is withdrawn and the segments 4 of the wall 2 return under their own resilience to the closed position and the fluid is kept in perfect condition, with a minimum and reduced contact time with the air.

The stopper 1 may preferably only be moved by the pipette 9 towards the bottom of the container or test-tube.

Although the description has been limited to the sample taking aspect, the inventive stopper allows all kinds of specimens to be inserted in and removed from the container, so that air may flow in or out of the said space through the said passages 10. In summary, the invention allows fluid to be inserted in or removed from the container without removing the stopper.

The shape of the body of the cavity and of the transverse wall may be of any convenient type as may also the number of slits in the transverse wall and the arrangement of the transverse wall in the body. In the same way, the number, spacing and shape of the ribs in the cavity may be as desired, thus there may be any number of ribs, being the same (as shown in the drawing) or different from the number of segments, the shape may be rounded (as illustrated) or angled and the spacing may be as illustrated or the ribs 6 may be juxtaposed, forming a toothed arrangement.

What I claim is:

1. A stopper for containers comprising: an integral single-piece body formed of a resilient material having a tubularly-shaped main portion and an inverted conically-shaped transverse end wall thereby defining an inner surface and an interiorly located cavity, said cavity containing a plurality of longitudinal ribs which extend radially inwardly from the inner surface of said tubularly-shaped main portion, the transverse wall being provided with at least one slit which defines segments of the transverse wall that abut one another to form a fluid tight seal, the transverse wall being perforatable by insertion of a tubular member into said interior cavity and through said at least one slit, the segments of the transverse wall resiliently closing to reseal said transverse wall when the tubular member is removed, and the longitudinal ribs providing vent passages when the tubular member is inserted through the transverse wall.

2. The stopper of claim 1 further comprising at least one annular protruding ring on an outer portion of the stopper that engages a container when the stopper is inserted into the container.

* * * * *